US007403176B2

(12) United States Patent
Chung et al.

(10) Patent No.: US 7,403,176 B2
(45) **Date of Patent: *Jul. 22, 2008**

(54) IMAGE DISPLAY DEVICE, AND DISPLAY PANEL AND DRIVING METHOD THEREOF, AND PIXEL CIRCUIT

(75) Inventors: Bo-Yong Chung, Seoul (KR); Yong-Sung Park, Seoul (KR); Won-Kyu Kwak, Seongnam (KR); Choon-Yul Oh, Gunpo (KR); Sun-A Yang, Suwon (KR); Do-Hyung Ryu, Busan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 232 days.

This patent is subject to a terminal disclaimer.

(21) Appl. No.: 10/634,337

(22) Filed: Aug. 4, 2003

(65) Prior Publication Data

US 2004/0217925 A1 Nov. 4, 2004

(30) Foreign Application Priority Data

Apr. 30, 2003 (KR) ..... 10-2003-0027604

(51) Int. Cl.
*G09G 3/32* (2006.01)

(52) U.S. Cl. ..... 345/76; 345/76; 345/204; 315/169.3

(58) Field of Classification Search ..... 345/76–83, 345/87–103, 204–205, 208–210; 315/169.1, 315/169.3

See application file for complete search history.

(56) References Cited

U.S. PATENT DOCUMENTS 4,595,919 A 6/1986 Holz et al.
5,426,447 A 6/1995 Lee
5,510,807 A 4/1996 Lee et al.

(Continued)

FOREIGN PATENT DOCUMENTS

CN 1361510 A 7/2002

(Continued)

OTHER PUBLICATIONS

European Search Report for Application No. EP 03 00 6113; Jan. 18, 2004; 2 pages.

(Continued)

*Primary Examiner*—Ricardo L Osorio
(74) *Attorney, Agent, or Firm*—Christie, Parker & Hale, LLP

(57) ABSTRACT

In a pixel circuit of an organic EL display device, a gate of a driving transistor is coupled to a gate of a compensating transistor, which is configured to operate as a diode. A precharge voltage is applied to the gate of the driving transistor while a selection signal is applied to a previous scan line, so that the compensating transistor is biased in a forward direction to apply a data voltage on the gate of the drive transistor. The driving transistor may be electrically isolated from the organic EL element (OLED) while precharging, so as to prevent the OLED from emitting a light using the precharge voltage. In addition, the driving transistor may be electrically isolated from the OLED while the data voltage is being charged, so as to prevent the OLED from emitting a light.

24 Claims, 11 Drawing Sheets

U.S. PATENT DOCUMENTS

| | | | | |
|---|---|---|---|---|
| 5,686,936 | A | 11/1997 | Maekawa et al. | |
| 5,708,454 | A | 1/1998 | Katoh et al. | |
| 5,835,072 | A | 11/1998 | Kanazawa | |
| 6,229,506 | B1 * | 5/2001 | Dawson et al. | 345/82 |
| 6,229,508 | B1 * | 5/2001 | Kane | 345/82 |
| 6,362,798 | B1 | 3/2002 | Kimura et al. | |
| 6,369,786 | B1 * | 4/2002 | Suzuki | 345/77 |
| 6,469,318 | B2 | 10/2002 | Yamada et al. | |
| 6,501,448 | B1 | 12/2002 | Komiya et al. | |
| 6,518,943 | B1 | 2/2003 | Masumura | |
| 6,580,408 | B1 | 6/2003 | Bae et al. | |
| 6,650,060 | B2 * | 11/2003 | Okuda | 315/169.1 |
| 6,731,266 | B1 | 5/2004 | Jung | |
| 6,760,005 | B2 * | 7/2004 | Koyama et al. | 345/98 |
| 6,791,129 | B2 | 9/2004 | Inukai | |
| 6,809,482 | B2 * | 10/2004 | Koyama | 315/169.3 |
| 6,989,826 | B2 * | 1/2006 | Kasai | 345/204 |
| 7,015,884 | B2 | 3/2006 | Kwon | |
| 7,209,101 | B2 * | 4/2007 | Abe | 345/76 |
| 2002/0047581 | A1 * | 4/2002 | Koyama | 315/169.3 |
| 2002/0118150 | A1 | 8/2002 | Kwon | |
| 2003/0179162 | A1 | 9/2003 | Ooe et al. | |
| 2003/0179164 | A1 | 9/2003 | Shin et al. | |
| 2004/0041769 | A1 | 3/2004 | Yamashita et al. | |

FOREIGN PATENT DOCUMENTS

| | | | |
|---|---|---|---|
| EP | 0 905 673 | A1 | 3/1999 |
| EP | 1 220 191 | A2 | 7/2002 |
| EP | 1 220 191 | A3 | 9/2003 |
| JP | 02082295 | A | 3/1990 |
| JP | 06-332397 | | 12/1994 |
| JP | 11-272233 | | 10/1999 |
| JP | 2002-351401 | | 12/2002 |
| JP | 2004-118196 | | 4/2004 |
| WO | WO01/06484 | A1 | 1/2001 |

OTHER PUBLICATIONS

Patents Abstracts of Japan, Publication No. JP11-272233, Published on Oct. 8, 1999 in the name of Kimura.

* cited by examiner

IMAGE DISPLAY DEVICE, AND DISPLAY PANEL AND DRIVING METHOD THEREOF, AND PIXEL CIRCUIT

CROSS REFERENCE TO RELATED APPLICATION

This application claims priority to and the benefit of Korean Patent Application No. 2003-0027604 filed on Apr.30, 2003 in the Korean Intellectual Property Office, the content of which is incorporated herein by reference.

BACKGROUND OF THE INVENTION (a) Field of the Invention

The present invention relates to an image display device, and a display panel and driving method thereof. More specifically, the present invention relates to an organic electroluminescent (hereinafter, referred to as "EL") display device.

(b) Description of the Related Art

The organic EL display device, which is a display device for electrically exciting a fluorescent organic compound to emit a light, has organic light-emitting cells that are voltage- or current-driven to display an image. These organic light-emitting cells have a structure composed of an anode (indium tin oxide (ITO)) layer, an organic thin film, and a cathode (metal) layer. For a good balance between electrons and holes to enhance luminescent efficiency, the organic thin film has a multi-layer structure that includes an emitting layer (EML), an electron transport layer (ETL), and a hole transport layer (HTL). The multi-layer structure of the organic thin film can also include an electron injecting layer (EIL), and a hole injecting layer (HIL).

There are two driving methods for these organic light-emitting cells: a passive matrix driving method, and an active matrix driving method using thin film transistors (TFTs). In the passive matrix driving method, anode and cathode stripes are arranged perpendicularly to each other to selectively drive the lines. On the other hand, in the active matrix driving method, a thin film transistor and a capacitor are coupled to ITO pixel electrodes so as to sustain a voltage by the capacity of the capacitor. According to the form of the signals applied to the capacitor to sustain the voltage, the active matrix driving method can be divided into a voltage programming method and a current programming method.

The voltage programming method is for displaying an image by applying a data voltage representing gradation to the pixel circuit, but may have a problem of non-uniformity due to a deviation of the threshold voltage of the driving transistor and the electron mobility. The current programming method is for displaying an image by applying a data current representing gradation to the pixel circuit, guaranteeing uniformity. But, this method is problematic in securing the time for charging the load of the data lines, since only a slight quantity of current is used in controlling the organic EL element.

A pixel circuit for compensating for the threshold voltage of the driving transistor in the voltage programming method is disclosed in U.S. Pat. No. 6,362,798 issued to Kimura et al.

The pixel circuit disclosed in U.S. Pat. No. 6,362,798 includes, as shown in FIG. 1, four transistors M1 to M4, and an organic EL element (OLED). The driving transistor M1 transfers a current corresponding to a voltage between its gate and source to OLED, and has a capacitor Cst between the gate and source. The transistor M2 is configured to operate as a diode (i.e., its gate and drain are connected together) and has the gate connected to the gate of the transistor M1. A gate of the switching transistor M3 is connected to a current scan line $S_n$, and a gate of the transistor M4 is connected to a previous scan line $S_{n-1}$.

When the threshold voltage of the transistor M1 is equal to that of the transistor M2, it can be compensated due to the transistor M2. But, when the gate voltage of the driving transistor M1 is higher than the data voltage applied through the transistor M3, the transistor M2 is diode-connected (i.e., configured to operate as a diode) in a reverse direction, as a result of which the data voltage cannot be transferred to the gate of the driving transistor M1. To prevent this phenomenon in the prior art, the precharge voltage $V_P$ is applied to the gate of the driving transistor M1 and sustained to be less than the lowest data voltage, while a selection signal is applied to the previous scan line $S_{n-1}$. In this manner, the gate voltage of the driving transistor M1 reaches the precharge voltage $V_P$ when the data voltage is applied, thereby coupling the transistor M2 in the forward direction.

A current flows through the driving transistor M1 due to a voltage corresponding to the difference between the precharge voltage $V_P$ and the power voltage $V_{DD}$, when the precharge voltage $V_P$ is transferred to the gate of the driving transistor M1. This current causes the OLED to emit a light, in which case normal black level cannot be displayed to represent black level gradation. Moreover, the current flows to the OLED while the data voltage is transferred to the gate of the driving transistor M1 and charged in the capacitor $C_{st}$, thereby increasing power consumption.

SUMMARY OF THE INVENTION

In one exemplary embodiment of the present invention, there is provided an image display device that compensates for the threshold voltage of the driving transistor and prevents an unnecessary current flowing to the display element. In said one exemplary embodiment, a transistor may be added between the driving transistor and the display element.

In an exemplary embodiment of the present invention, there is provided a display panel for image display that includes a plurality of data lines for transferring a data voltage representing an image signal, a plurality of scan lines, each scan line for transferring a selection signal, and a plurality of pixel circuits, each pixel circuit being coupled to a corresponding said data line and two adjacent said scan lines. The pixel circuit includes a display element, first and second transistors, and first, second and third switching elements. The first transistor generates a current corresponding to a voltage between its main electrode and control electrode. A capacitor is coupled between the main electrode and the control electrode. The second transistor is configured to operate as a diode, and has a control electrode coupled to the control electrode of the first transistor. The first switching element is coupled to a main electrode of the second transistor, and transfers the data voltage from the data lines to the second transistor in response to the selection signal from one of the two adjacent scan lines. The second switching element transfers a precharge voltage to the control electrode of the first transistor in response to a first control signal before the data voltage is supplied. The third switching element is turned off in response to a second control signal for electrically isolating the first transistor from the display element.

In another exemplary embodiment, the data voltage is applied to the data lines after transferring the precharge voltage in response to the first control signal and before applying the selection signal to the current scan line.

In another exemplary embodiment, the second control signal includes the first control signal. The selection signal from the previous scan line is used as both the first and second control signals. The second switching element is a transistor of a first conductive type, and the third switching element is a transistor of a second conductive type, which is an opposite of the first conductive type.

In another exemplary amendment of the present invention, the second control signal is a selection signal from the current scan line. The second switching element is a transistor of a first conductive type, and the third switching element is a transistor of a second conductive type, which is an opposite of the first conductive type. The first control signal is a selection signal from a previous scan line.

In yet another exemplary embodiment of the present invention, there is provided an image display device that includes the above-described display panel.

In still another exemplary embodiment of the present invention, there is provided a method for driving an image display device coupled to two adjacent scan lines. The image display device includes a first transistor having a main electrode and a control electrode with a capacitor coupled therebetween, the first transistor capable of generating a current corresponding to a voltage charged in the capacitor, a second transistor having a control electrode coupled to the control electrode of the first transistor and being configured to operate as a diode, and a display element capable of displaying a portion of an image corresponding to a quantity of the current generated by the first transistor. The method includes: transferring a precharge voltage to the control electrode of the first transistor in response to a first control signal during a first time period; transferring a data voltage to the control electrode of the first transistor through the second transistor in response to a selection signal from one of the two adjacent scan lines during a second time period; and interrupting the transfer of the data voltage. The first transistor is electrically isolated from the display element during at least one of the first time period and the second time period.

In a further exemplary embodiment, the first control signal is a selection signal from a previous scan line. The first transistor is electrically isolated from the display element in response to the first control signal during the first time period.

In a still further exemplary embodiment, the first transistor is electrically isolated from the display element in response to the second control signal during the second time period. The second control signal is a selection signal from the current scan line.

In yet further exemplary embodiment, a time period of preventing the precharge voltage and the data voltage from being transferred to the control electrode of the first transistor is included between the first and second time periods.

In still another exemplary embodiment of the present invention, there is provided a pixel circuit, which responds to a precharge voltage from a first signal line and a data voltage representing an image signal from a second signal line. The pixel circuit includes first and second transistors, a display element, and switching means. The first transistor has a main electrode and a control electrode with a capacitor coupled therebetween, and is capable of generating a current in response to a voltage charged in the capacitor. The second transistor has a control electrode coupled to the control electrode of the first transistor and is configured to operate as a diode. The display element is capable of displaying a portion of an image, said image portion corresponding to the current generated by the first transistor. The switching means is coupled between the first transistor and the display element. The precharge voltage is applied to the control electrode of the first transistor in response to a control signal for a first time period, and the data voltage is applied to the control electrode of the first transistor in response to a select signal for a second time period. The first transistor is electrically isolated from the display element by the switching means during at least one of the first time period and the second time period.

In yet another exemplary embodiment of the present invention is provided a display device that includes a display element, a first transistor, a first switching element and a capacitor. The display element is for displaying a portion of an image in response to a current being applied. The first transistor has a main electrode and a control electrode, and is coupled between a voltage source and the display element. The capacitor is coupled between the main electrode and the control electrode, wherein the first transistor is capable of generating the current in response to a charge in the capacitor. The first switching element is coupled between the first transistor and the display element to interrupt the current to the display element while charging the capacitor using at least one of a precharge voltage and a data voltage representative of the image portion.

BRIEF DESCRIPTION OF THE DRAWINGS

The accompanying drawings, which together with the specification, illustrate exemplary embodiments of the present invention, and, together with the description, serve to explain the principles of the present invention.

DETAILED DESCRIPTION

In the following detailed description, exemplary embodiments of the present invention are shown and described, by way of illustration. As those skilled in the art would recognize, the described embodiments may be modified in various different ways, all without departing from the spirit or scope of the present invention. Accordingly, the drawings and description are to be regarded as illustrative in nature, and not restrictive.

The parts not related to the description are omitted in the Figures for more definite description of the present invention. When a component is described as being coupled to another component it refers to cases where the two components are directly coupled to each other, and additionally to cases where the two components are coupled to each other with a third element between them.

Figure 2:
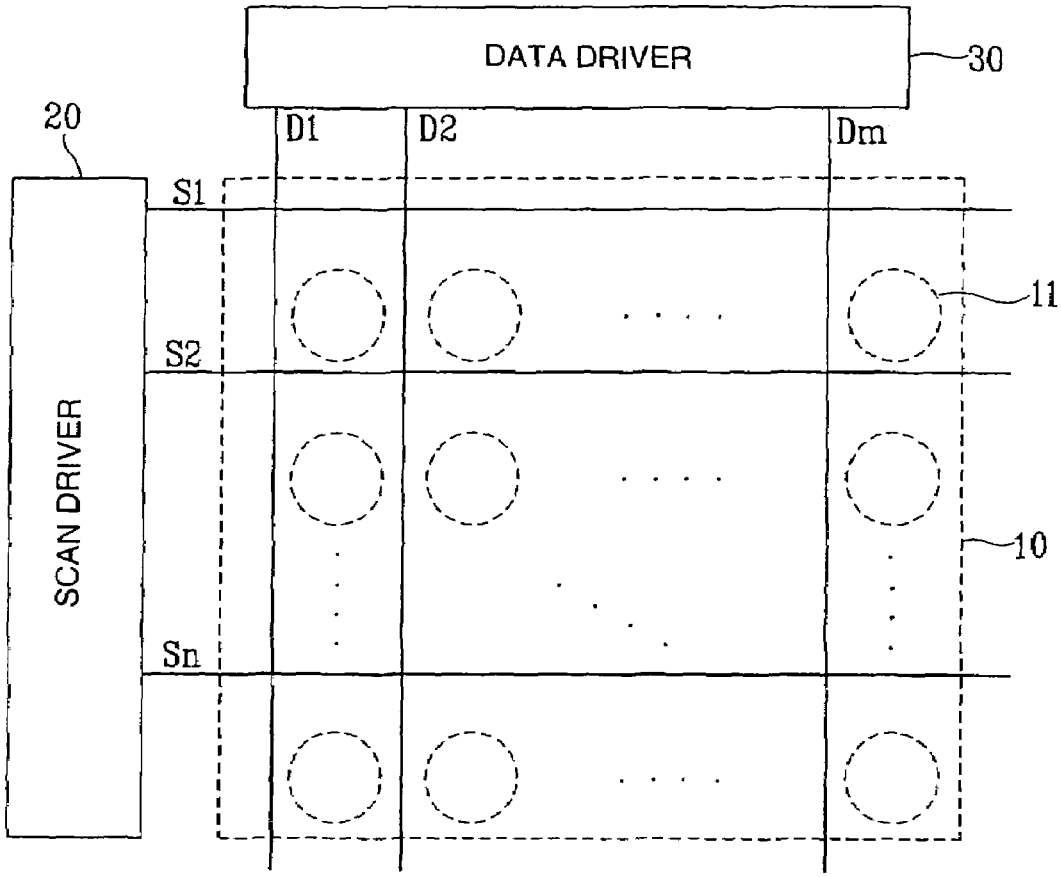
FIG. 2 is a schematic diagram of an organic EL display device according to an embodiment of the present invention.

Now, reference will be made to FIG. 2 in the description of an organic EL display device according to an exemplary embodiment of the present invention. FIG. 2 is a schematic diagram of the organic EL display device according to the exemplary embodiment of the present invention.

The organic EL display device according to the described embodiment of the present invention includes, as shown in FIG. 2, an organic EL display panel 10, a scan driver 20, and a data driver 30.

The organic EL display panel 10 includes a plurality of data lines $D_1$ to $D_M$ arranged in columns, a plurality of scan lines $S_1$ to $S_N$ arranged in rows, and a plurality of pixel circuits 11. The data lines $D_1$ to $D_M$ transfer a data voltage representing an image signal to the pixel circuits 11. The scan lines $S_1$ to $S_N$ transfer a selection signals for selecting the pixel circuits 11. Each of the pixel circuits 11 is formed in a pixel area defined by two adjacent data lines and two adjacent scan lines.

The scan driver 20 sequentially applies the selection signal to the scan lines $S_1$ to $S_N$, and the data driver 30 applies the data voltage representing an image signal to the data lines $D_1$ to $D_M$.

The scan driver 20 and/or the data driver 30 can be coupled to the display panel 10, or mounted in the form of a chip on a tape carrier package (TCP) that is coupled to the display panel 10 by soldering. The scan driver 20 and/or the data driver 30 can also be mounted in the form of a chip on a flexible printed circuit (FPC) or a film coupled to the display panel by soldering. This method is called "CoF (Chip on Flexible board, or Chip on Film)". Further, the scan driver 20 and/or the data driver 30 can be mounted directly on the glass substrate of the display panel, or replaced for the driving circuit that includes is the same layers as scan and data lines and thin film transistors on the glass substrate. This method is called "CoG (Chip on Glass)". In other embodiments, the scan driver 20 and/or the data driver 30 may be mounted on any other suitable location using any suitable mounting method.

Figure 3:
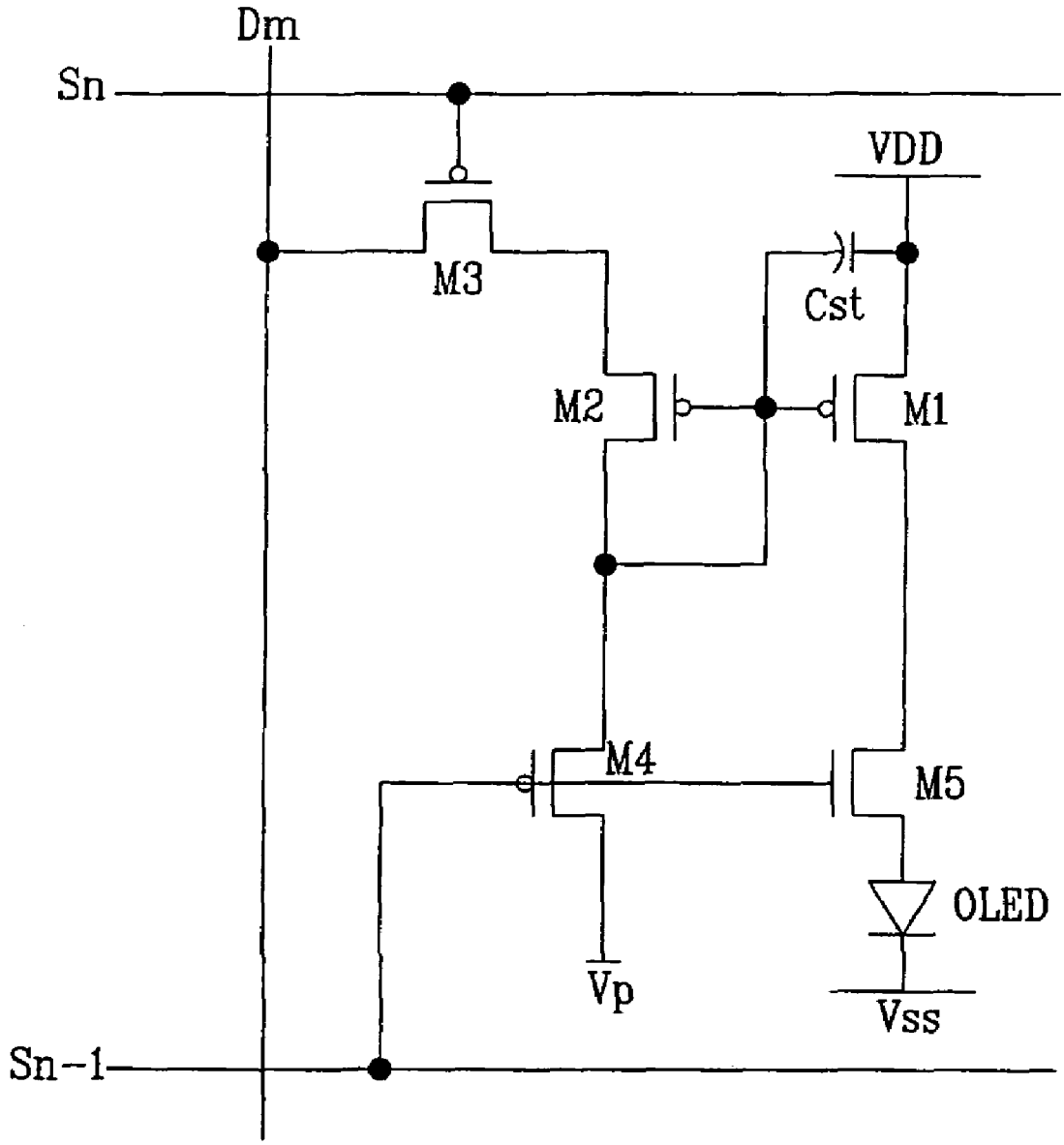
FIGS. 3, 5, 7, 8 and 10 are equivalent circuit diagrams of pixel circuits according to exemplary embodiments of the present invention.
Figure 4:
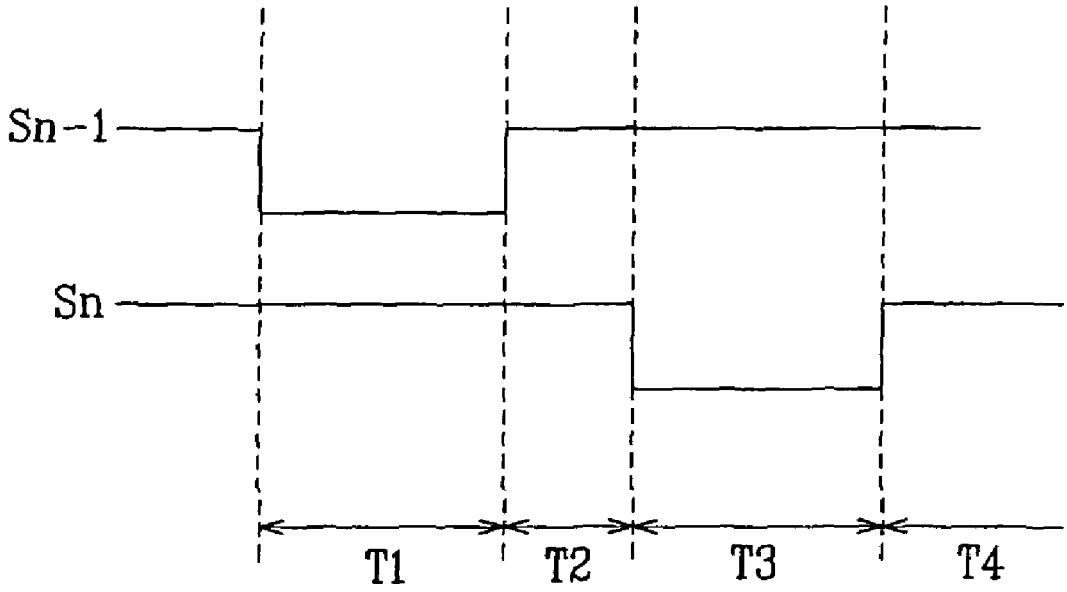
FIGS. 4, 6 and 11 are driving waveform diagrams for driving the pixel circuits shown in FIGS. 3, 5 and 10, respectively.

Next, the pixel circuit 11 of the organic EL display panel according to an exemplary embodiment of the present invention will be described in detail with reference to FIGS. 3 and 4. FIG. 3 is an equivalent circuit diagram of the pixel circuit according to the exemplary embodiment of the present invention, and FIG. 4 is a driving waveform diagram for driving the pixel circuit shown in FIG. 3. For example, the pixel circuit is coupled to the m-th data line $D_m$ and the n-th scan line $S_n$ in FIG. 3. The pixel circuit may be coupled to any other data line/scan line combination illustrated in FIG. 2. The term "current scan line" as used herein refers to a scan line for transferring a current selection signal, and the term "previous scan line" as used herein refers to a scan line for transferring a selection signal prior to the current selection signal.

The pixel circuit 11 according to the exemplary embodiment of the present invention includes, as shown in FIG. 3, an organic EL element (OLED), transistors M1 to M5, and a capacitor $C_{st}$. The transistors M1 to M4 are PMOS type transistors, and the transistor M5 is an NMOS type transistor. These transistors M1 to M5 should be thin film transistors, each of which has gate, drain and source electrodes formed on the glass substrate of the display panel 10 as a control electrode and two main electrodes, respectively.

The driving transistor M1 has a source electrode coupled to a power voltage $V_{DD}$. A capacitor $C_{st}$ is coupled between the source electrode and a gate electrode. The capacitor $C_{st}$ sustains gate-source voltage $V_{GS}$ of the transistor M1 for a period of time, which may be predefined. The compensating transistor M2 is configured to operate as a diode (i.e., its gate and drain are coupled together). The gate of the compensating transistor M2 is also coupled to the gate of the transistor M1. The switching transistor M3 transfers, to the transistor M2, a data voltage from the data line $D_m$ in response to a selection signal from the current scan line $S_n$. The drain of the transistor M2 is coupled to the transistor M4. The transistor M4 transfers a precharge voltage $V_P$ to the transistor M2 in response to the selection signal from the previous scan line $S_{n-1}$.

The transistor M5 is coupled between the drain of the transistor M1 and the anode of the OLED, and electrically isolates the transistor M1 from the OLED in response to the selection signal from the previous scan line $S_{n-1}$. The OLED has a cathode coupled to a reference voltage $V_{SS}$, and emits a light corresponding to the current applied. The reference voltage $V_{SS}$ is lower than the power voltage $V_{DD}$ and may be a ground voltage.

Now, the operation of the pixel circuit according to the exemplary embodiment of the present invention will be described in detail with reference to FIG. 4.

Referring to FIG. 4, during a precharge time period T1, the selection signal from the previous scan line $S_{n-1}$ becomes "low" to turn the transistor M4 on and the transistor M5 off. With the transistor M4 on, the precharge voltage $V_P$ is transferred to the gate of the transistor M1. The precharge voltage $V_P$ is slightly lower than any data voltage applied to the gate of the transistor M1 through the transistor M2 (taking into account the voltage drops in the transistors M2 and M4, respectively), i.e., the lowest data voltage applied through the data line $D_m$, for the sake of acquiring a maximum gradation level. In this manner, the data voltage is always higher than the gate voltage of the transistor M1 when it is applied through the data line $D_m$. Therefore, the transistor M1 is coupled in the forward direction so that the data voltage is charged in the capacitor $C_{st}$.

During the precharge time period T1, the gate-source voltage $V_{GS}$ of the transistor M1 is increased due to the precharge voltage $V_P$, so that a high current would flow through the transistor M1 if a current path is available. If supplied to the OLED, this current would cause the OLED to emit a light, thereby preventing an accurate representation of a black level gradation. According to the exemplary embodiment of the present invention, the turned-off transistor M5 electrically isolates the transistor M1 from the organic OLED to prevent a current flow, which otherwise would have been caused by the precharge voltage $V_P$. This enables an accurate representation of black level gradation and prevents an unnecessary current flow, thereby also reducing power consumption.

During a blanking time period T2, the selection signal from the previous scan line $S_{n-1}$ becomes "high" while the selection signal from the current scan line $S_n$ is sustained at a high level. In this time period T2, the voltage on the data line $D_m$ is changed to a data voltage corresponding to the pixel circuit coupled to the current scan line $S_n$. In other words, voltage on the data line $D_m$ should be saturated to a desired data voltage during the blanking time period T2. Without the blanking time period T2, the previous data voltage applied to the data line $D_m$ may be transferred to the transistor M1 via the transistor M3 when the selection signal from the current scan line $S_n$ becomes "low" before the current data voltage is applied.

During a data charge period T3, the selection signal from the current scan line $S_n$ becomes "low" to turn the transistor M3 on. Then the data voltage from the data line $D_m$ is transferred to the transistor M2 through the transistor M3. The transistor M2 is configured to operate as a diode, so the voltage corresponding to the data voltage minus threshold voltage $V_{TH2}$ of the transistor M2 is transferred to the gate of the transistor M1. This voltage is charged in the capacitor $C_{st}$ and sustained for a period of time, which may be predefined. Further, the selection signal from the previous scan line $S_{n-1}$, becomes "high" to turn the transistor M5 on. In practice, as indicated on FIG. 4, the selection signal line $S_{n-1}$ from the previous scan line becomes "high" during the blanking time period T2, thereby turning on the transistor M5.

During a light-emitting time period T4, a current $I_{OLED}$ corresponding to the gate-source voltage $V_{GS}$ of the transistor M1 is supplied to the OLED, so the OLED emits a light. The current $I_{OLED}$ can be defined as follows.

$$I_{OLED} = \frac{\beta}{2}(|V_{GS}| - |V_{TH1}|)^2 = \frac{\beta}{2}(V_{DD} - (V_{DATA} - |V_{TH2}|) - |V_{TH1}|)^2 \quad \text{[Equation 1]}$$

where $V_{TH1}$ is the threshold voltage of the transistor M1; $V_{DATA}$ is the data voltage from the data line $D_m$; and β is a constant.

When the threshold voltage $V_{TH1}$ of the transistor M1 is equal to the threshold voltage $V_{TH2}$ of the transistor M2, the equation 1 can be rewritten as:

$$I_{OLED} = \frac{\beta}{2}(V_{DD} - V_{DATA})^2 \quad \text{[Equation 2]}$$

Accordingly, a current corresponding to the data voltage applied through the data line $D_m$ flows to the OLED irrespective of the threshold voltage $V_{TH1}$ of the transistor M1.

In this manner, the exemplary embodiment of the present invention compensates for a deviation of the threshold voltage of the driving transistor M1 and prevents the current from flowing to the OLED caused by the precharge voltage $V_P$.

The pixel circuit according to the exemplary embodiment of the present invention uses the previous scan line $S_{n-1}$ so as to control the transistors M4 and M5. In other embodiments, a separate control line (not shown) may be used to transfer a control signal for turning the transistor M4 on and/or the transistor M5 off during the precharge time period T1.

In the exemplary embodiment of the present invention, the type of the transistor M5 is an opposite of that of the transistor M4 so as to turn the transistor M5 off during the precharge time period T1. The transistor M5 may have the same type as the transistor M4 in another embodiment of the present invention, which will be described, for example, in detail with reference to FIGS. 5 and 6 as follows.

Figure 5:
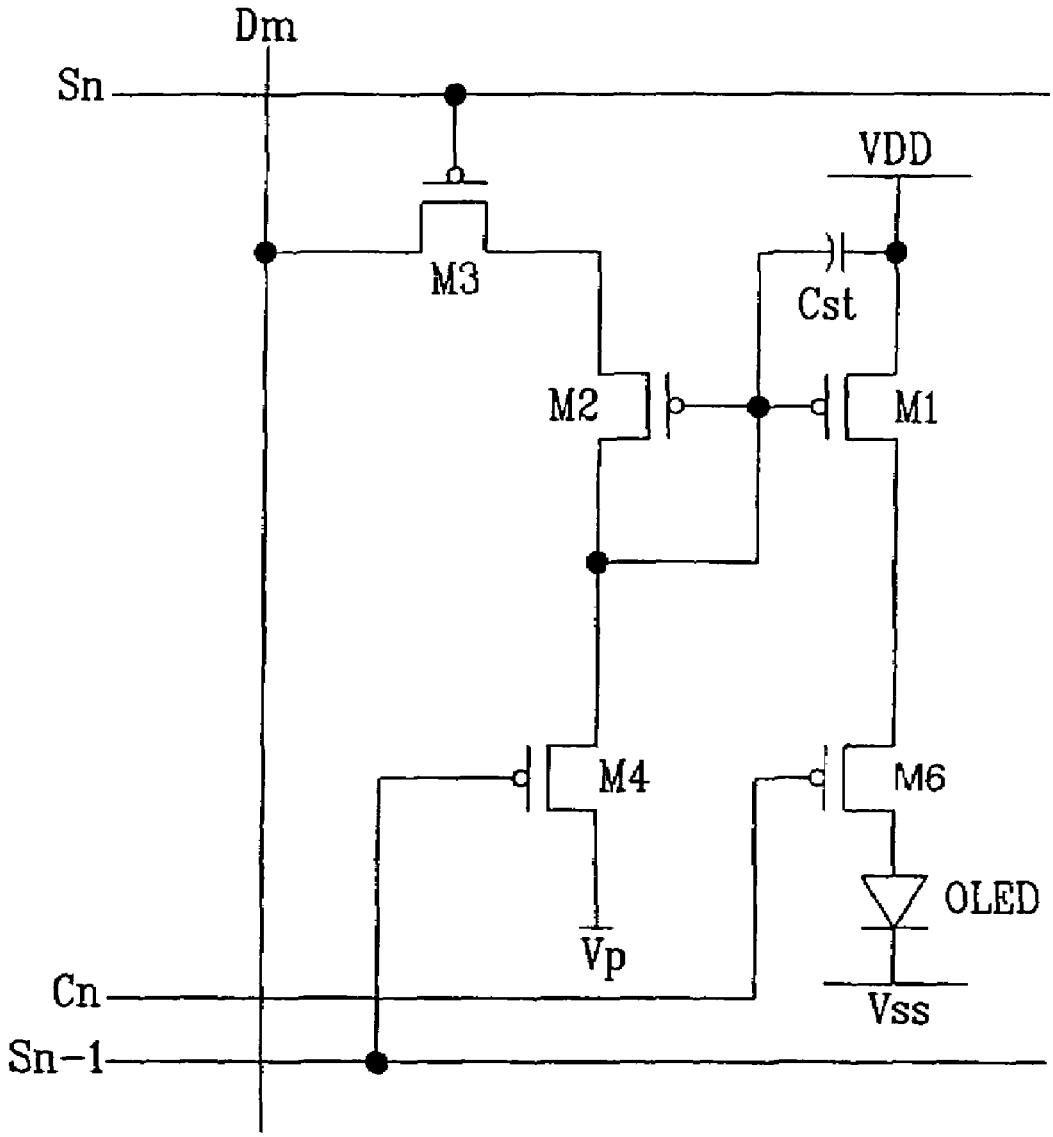
Figure 6:
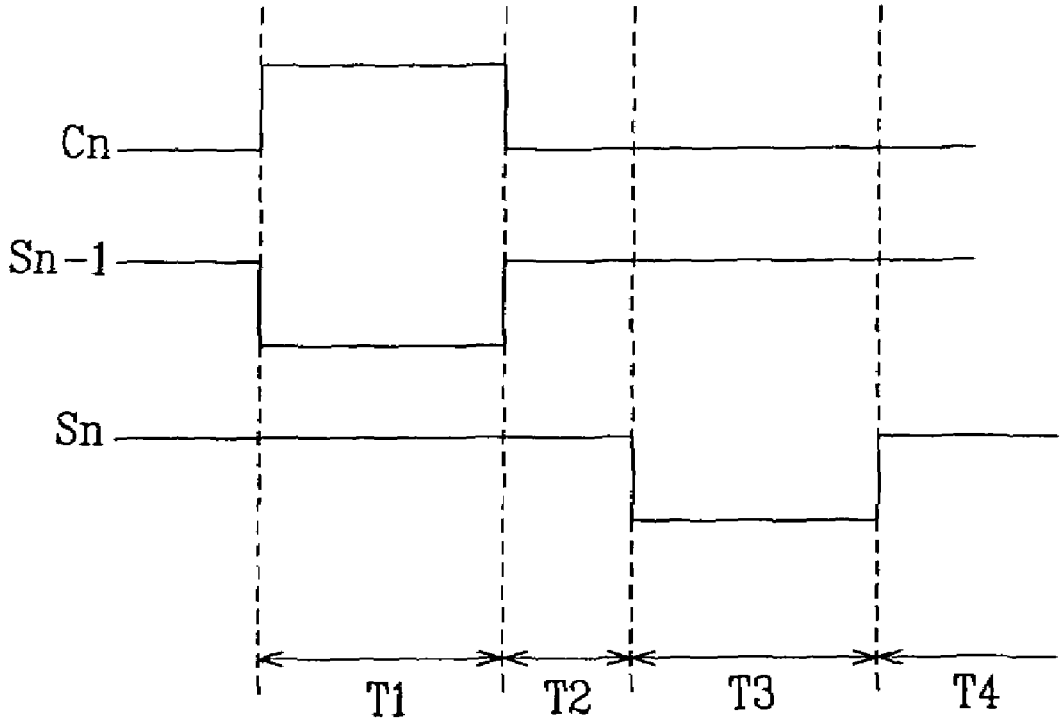

FIG. 5 is an equivalent circuit diagram of the pixel circuit according to another exemplary embodiment of the present invention, and FIG. 6 is a driving waveform diagram for driving the pixel circuit shown in FIG. 5.

The pixel circuit according to this exemplary embodiment of the present invention has the same structure as the exemplary embodiment of FIG. 3 except for the type of the transistor M6 (which is different from the type of the transistor M5 of FIG. 3) and an addition of a control line $C_n$. More specifically, the transistor M6 is a PMOS type transistor, which is the same type as the transistors M1 to M4, and turns off in response to a "high" control signal from the control line $C_n$. The control signal applied to the control line $C_n$ is an inversed form of the selection signal applied to the previous scan line $S_{n-1}$ as shown in FIG. 6. Hence, the transistor M6 is turned off during the precharge time period T1 to interrupt the current flowing to the OLED, as in the exemplary embodiment of FIG. 3.

In this manner, this exemplary embodiment implements the pixel circuit with the transistors of the same type, thereby simplifying the fabrication process relative to the exemplary embodiment of FIG. 3.

The above described exemplary embodiments additionally use the transistors M5 and M6, respectively, so as to interrupt the current flowing to the OLED during the precharge time period T1. In other exemplary embodiments, a transistor may be added in addition to (or instead of) the transistor M5 or M6, and the driving waveform may be selected so as to interrupt the current flowing to the OLED during the data charge time period T3. One such exemplary embodiment will be described in detail with reference to FIG. 7 as follows.

Figure 7:
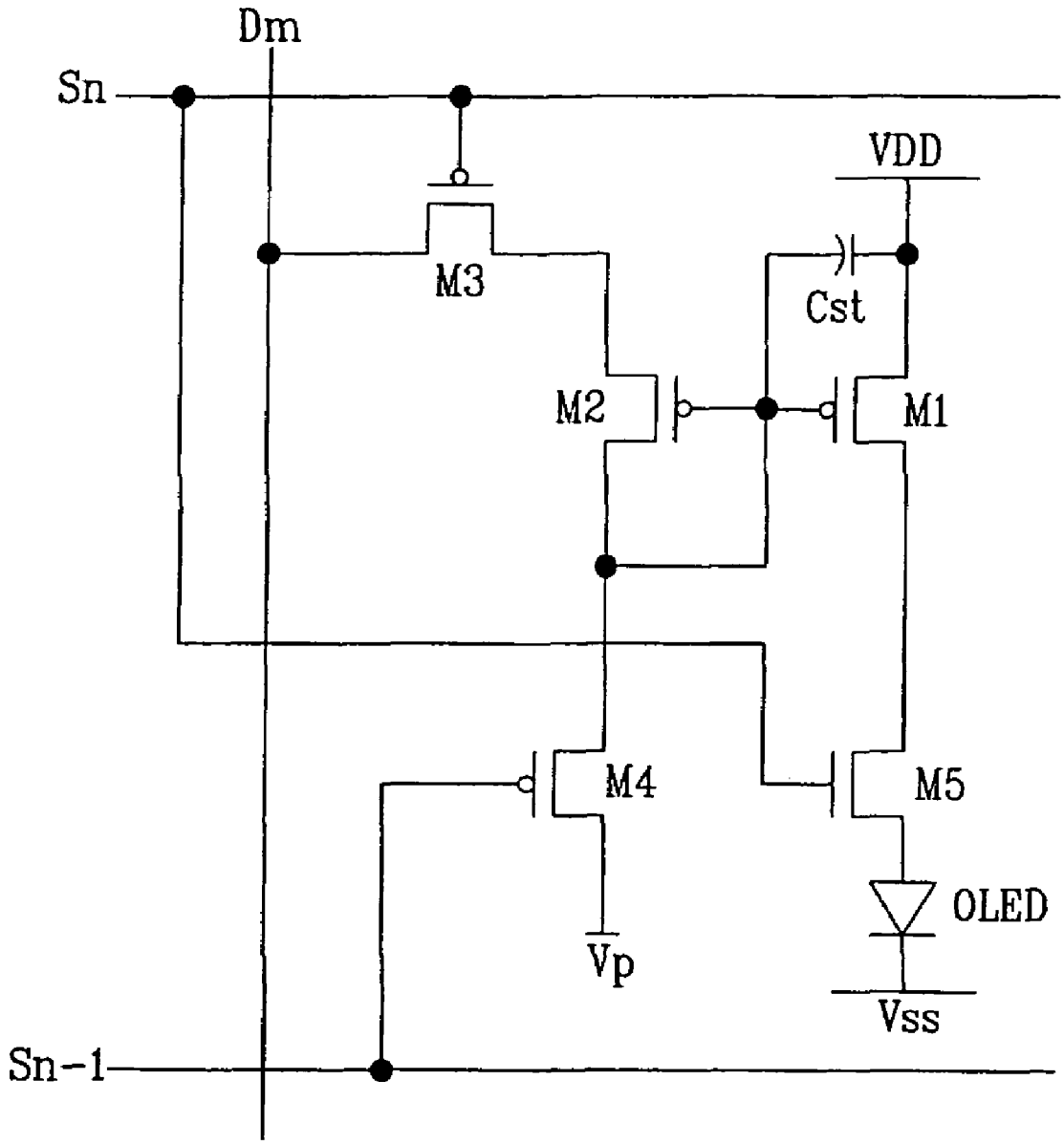

FIG. 7 is an equivalent circuit diagram of a pixel circuit according to yet another exemplary embodiment of the present invention.

Referring to FIG. 7, the pixel circuit according to this exemplary embodiment has a transistor M5 coupled between the transistor M1 and the OLED. The transistor M5 is an NMOS type transistor similar to the transistor M5 of FIG. 3. However, the transistor M5 has a gate coupled to the current scan line $S_n$. The pixel circuit in this exemplary embodiment is driven by the driving waveform of FIG. 4.

In this manner, the transistor M5 is turned off in response to the selection signal from the current scan line $S_n$ to electrically isolate the transistor M1 from the OLED while the data voltage from the data line $D_m$ is charged in the capacitor $C_{st}$ during the data charge time period T3. Thus, the current flowing to the OLED is interrupted while the data voltage is charged in the capacitor $C_{st}$.

As the selection signal from the current scan line $S_n$ becomes "high", the transistor M5 is turned on to couple the transistor M1 to the OLED. Hence, a current $I_{OLED}$ corresponding to the voltage charged in the capacitor $C_{st}$ flows to the OLED, which then emits light in the light-emitting time period T4. Therefore, in this embodiment, the current flowing to the OLED is interrupted while the data voltage is charged, thereby reducing power consumption.

In yet another exemplary embodiment, the transistor M5 may be of the same transistor type as the switching transistor M3. In that exemplary embodiment, the transistor M5 may be driven by a signal of an inversed form of the selection signal applied to the scan line $S_n$ to realize an equivalent pixel circuit as the pixel circuit of FIG. 7.

In the exemplary embodiment of FIG. 7, the current does not flow (i.e., is interrupted) to the OLED during the data charge time period T3. The current flowing to the OLED may also be interrupted during the precharge time period T1 in other exemplary embodiments, one of which will be described in detail with reference to FIGS. 8 and 9 as follows.

Figure 1:
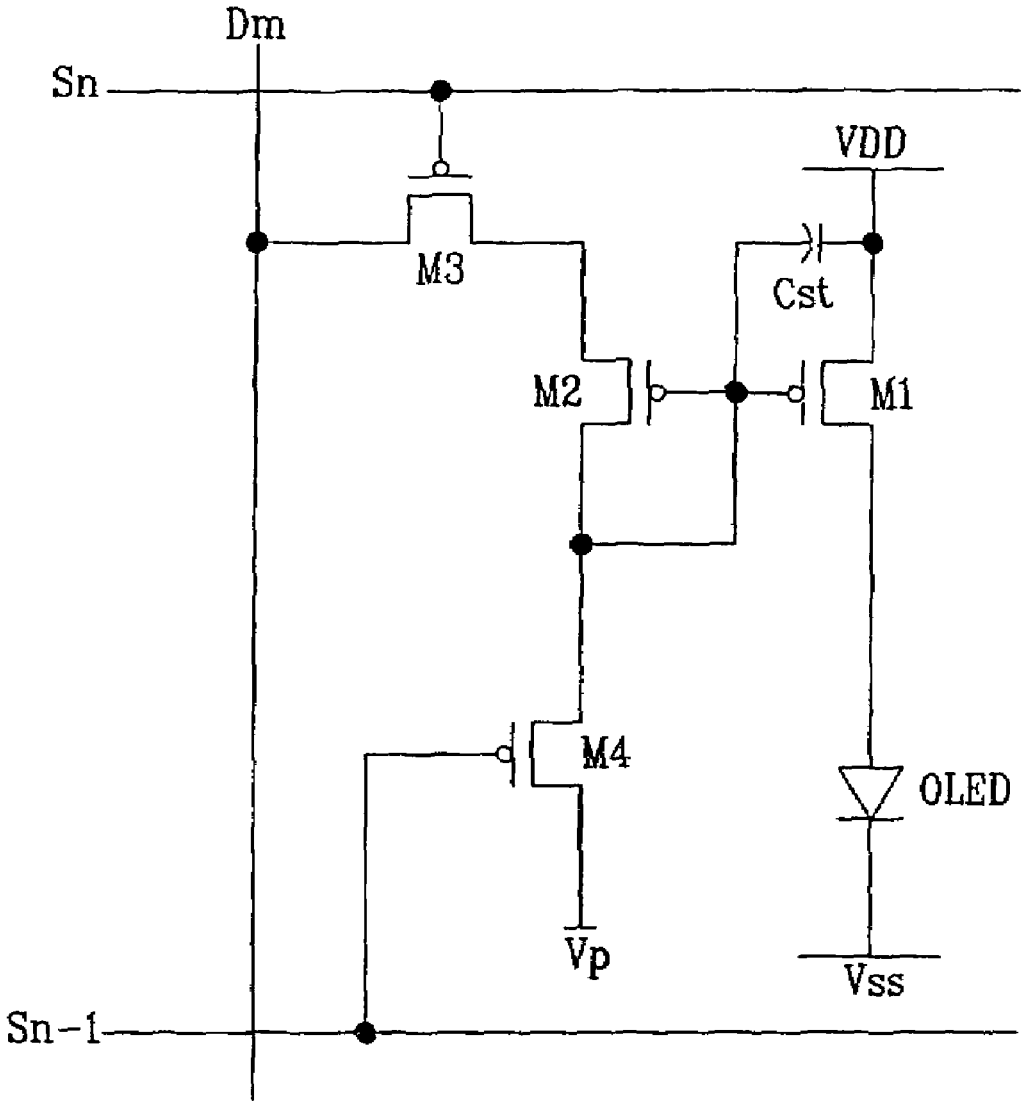
FIG. 1 is an equivalent circuit diagram of a pixel circuit according to prior art.
Figure 8:
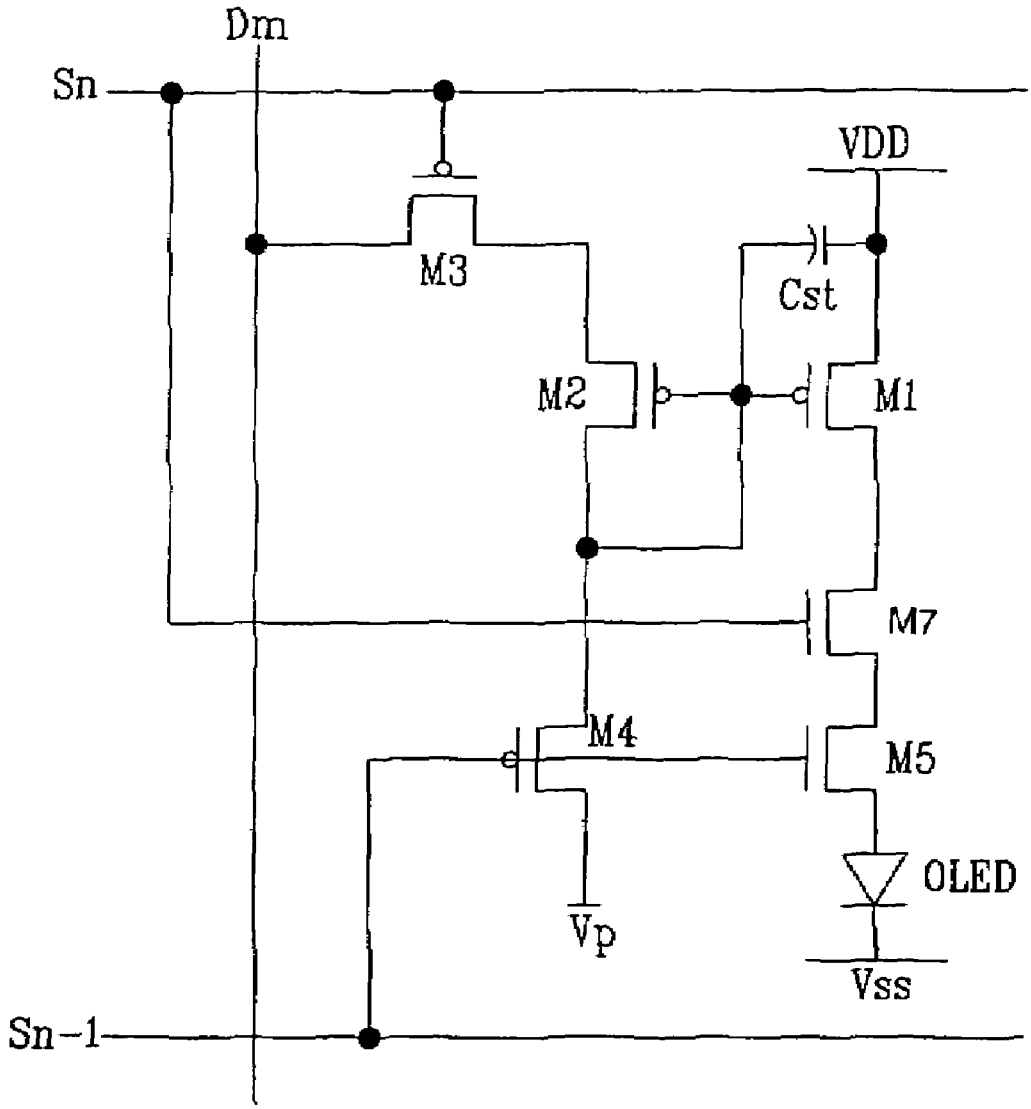
Figure 9:
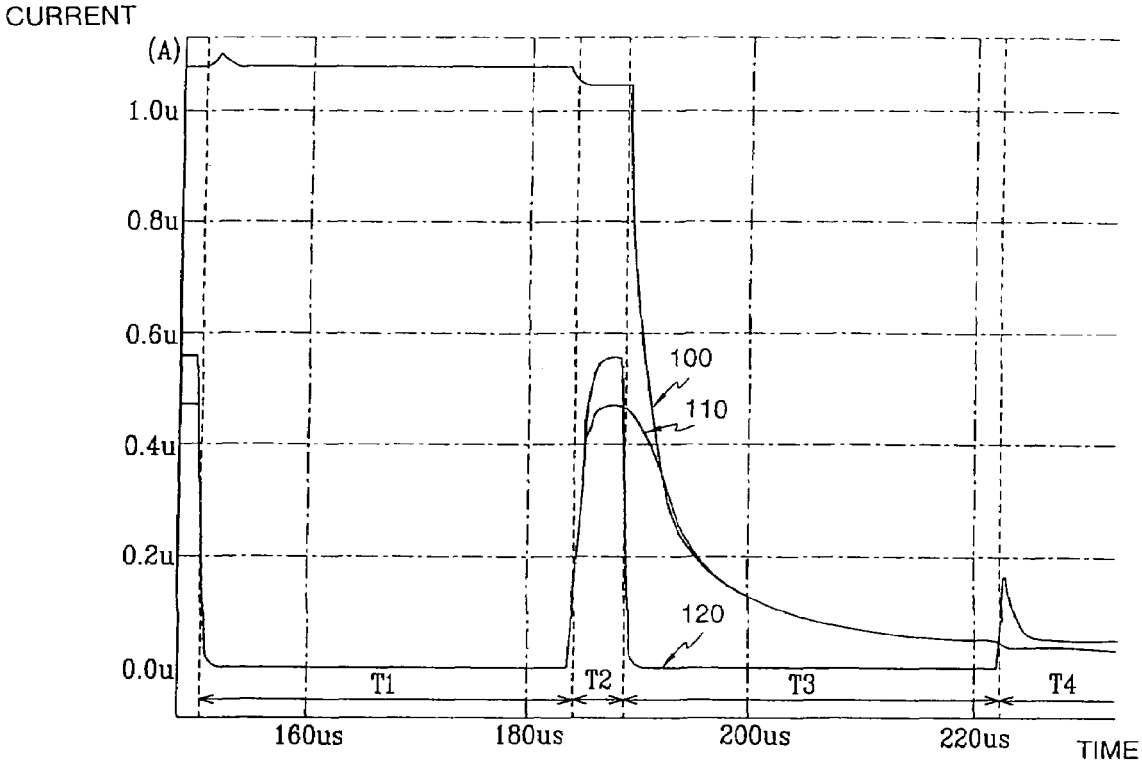
FIG. 9 is a diagram showing graphs that depict a current flowing to the organic EL element in the pixel circuit.

FIG. 8 is an equivalent circuit diagram of the pixel circuit according to still another exemplary embodiment of the present invention, and FIG. 9 shows a current flowing to the OLED in the pixel circuits shown in FIGS. 1, 3 and 8, respectively.

Referring to FIG. 8, the pixel circuit according to this exemplary embodiment has a transistor M7 added to the pixel circuit in the exemplary embodiment of FIG. 3. For example, the transistors M7 and M5 are coupled in series between the transistor M1 and the anode of the OLED, and formed with NMOS transistors. The gate of the transistor M5 is coupled to the previous scan line $S_{n-1}$, and that of the transistor M7 is coupled to the current scan line $S_n$. Here, the transistors M5 and M7 can be switched in position. The pixel circuit of FIG. 8 is driven using the driving waveform of FIG. 4.

In this manner, the transistor M5 is turned off in response to the selection signal from the previous scan line $S_{n-1}$ during the precharge time period T1, so that no current flows to the OLED in response to the precharge voltage $V_P$. Further, the transistor M7 is turned off in response to the selection signal from the current scan line $S_n$ during the data charge time period T3, so that no current flows to the OLED while the data voltage is charged. In the light-emitting time period T4, both the transistors M5 and M7 are turned on, and a current corresponding to the voltage charged in the capacitor $C_{st}$ flows to the OLED.

In other embodiments, the transistor M5 may have the same transistor type as the transistor M4 and applied with a signal having an inversed form of the selection signal applied to the previous scan line $S_{n-1}$ to the gate of the transistor M5. Similarly, the transistor M7 may be formed to have the same transistor type as the transistor M3, and applied with a signal having an inversed form of the selection signal applied to the current scan line $S_n$. The operation of such pixel circuits would be equivalent to that of the pixel circuit of FIG. 8.

Referring to FIG. 9, the pixel circuit of FIG. 1, as shown on graph 100, allows a current to flow to the OLED during both the precharge time period T1 and the data charge time period T3. On the other hand, the pixel circuit of FIG. 3, as shown on graph 110, allows a current to flow to the OLED not in the precharge time period T1 but in the data charge time period T3. Unlike the pixel circuits of FIGS. 1 and 3, the pixel circuit of FIG. 8, as shown on graph 120 does not allow a current to flow to OLED during both the precharge time period T1 and the data charge time period T3.

Although the transistors M1 to M4 are formed with PMOS type transistors in the above described exemplary embodiments, they may also be formed with NMOS type transistors in other embodiments. One such exemplary embodiment will be described in detail with reference to FIGS. 10 and 11. In still other embodiments, the transistors M1 to M4 may be any other suitable transistors.

Figure 10:
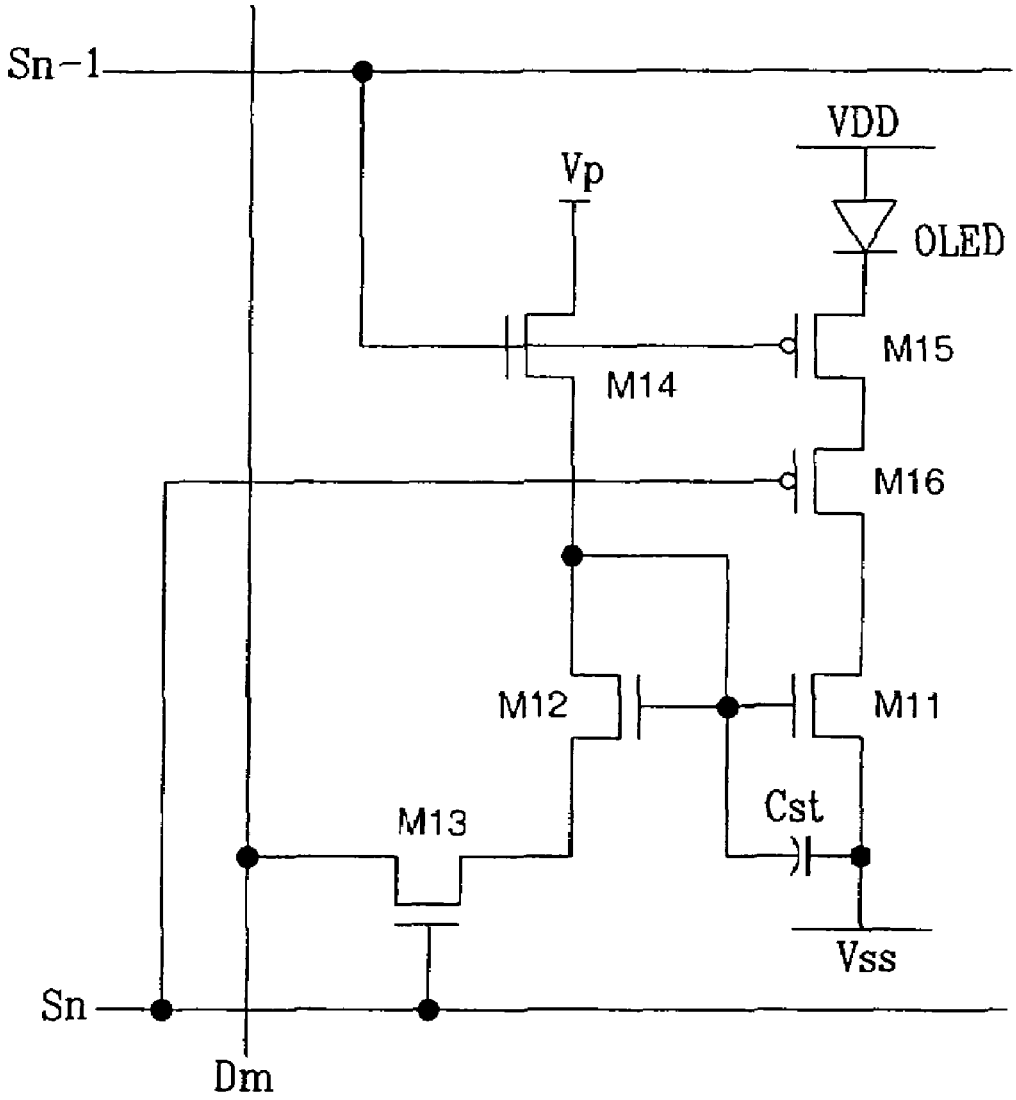
Figure 11:
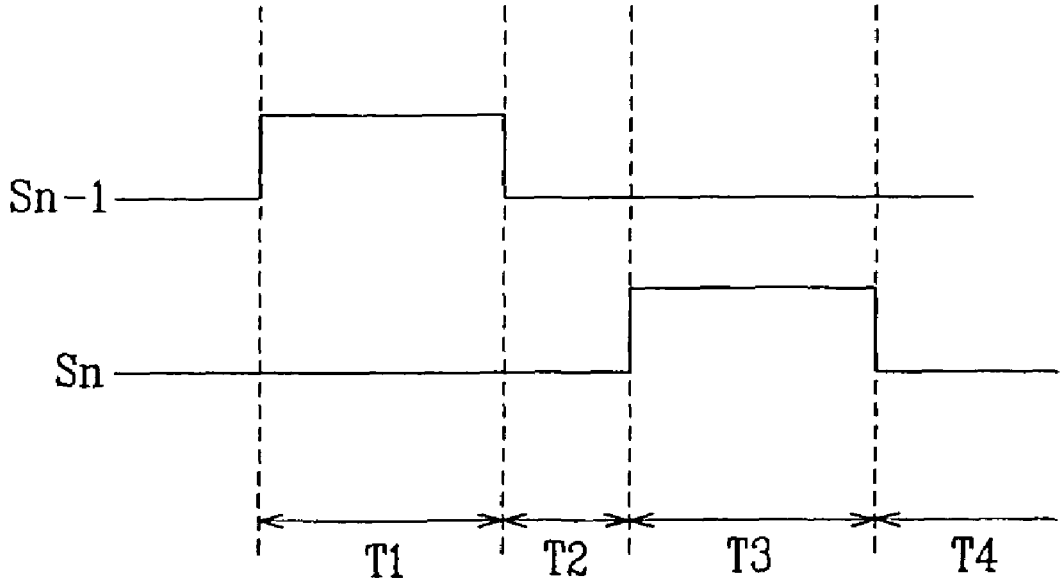

FIG. 10 is an equivalent circuit diagram of the pixel circuit according to a still further exemplary embodiment of the present invention, and FIG. 11 is a driving waveform diagram for the pixel circuit shown in FIG. 10.

The pixel circuit according to this embodiment, as shown in FIG. 10, has transistors M11 to M14 formed with NMOS type transistors, and transistors M15 and M16 formed with PMOS type transistors. The pixel circuit of FIG. 10 also has a structure that is symmetrical to the pixel circuit of FIG. 8. More specifically, the transistor M11 has a source electrode coupled to the reference voltage $V_{SS}$, and the OLED has an anode coupled to the power voltage $V_{DD}$. The transistors M15 and M16 are coupled in series between the cathode of the OLED and the drain of the transistor M11.

Referring to FIG. 11, the driving waveform for the pixel circuit of FIG. 10 has an inverted form of the driving waveform (in FIG. 4) of the pixel circuit of FIG. 8. The pixel circuit of FIG. 10 performs an equivalent operation as the pixel circuit of FIG. 8, and its operation will not be described in detail.

The transistors M11 to M14 formed with NMOS type transistors can be applied to all the embodiments of the present invention. Likewise, if the same functions of the above-stated transistors are enabled, the pixel circuit can be implemented with a combination of PMOS and NMOS transistors or other switching elements.

As described above, the exemplary embodiments according to the present invention may compensate for a deviation of the threshold voltage of the transistors when the driving transistor has the same threshold voltage as the compensating transistor. In the pixel circuits of the exemplary embodiment, a current may not be provided to the OLED while the precharge voltage is being charged in a capacitor, thereby allowing an accurate representation of black level gradation, which may enhance a contrast ratio. Further, a current may not be provided to the OLED while the data voltage is being charged, thereby reducing power consumption.

Although exemplary embodiments of the present invention have been described by way of an organic EL display device, the present invention is not specifically limited to the organic EL display device and may be applied to other light-emitting display devices that emit a light in response to the current applied.

While this invention has been described in connection with certain exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A display panel for image display using a voltage programming method, said display panel comprising a plurality of data lines for transferring a data voltage representing an image signal, a plurality of scan lines, and a plurality of pixel circuits, each pixel circuit being coupled to a corresponding said data line, a current scan line among the scan lines for transferring a current selection signal and a previous scan line among the scan lines for tranferring a previous selection signal, each pixel circuit comprising:

a display element for displaying a portion of an image, the image portion corresponding to a quantity of applied current;

a first transistor having a main electrode and a control electrode;

a capacitor coupled between the main electrode and the control electrode of the first transistor, wherein the first transistor is for generating the applied current in response to a voltage between the main electrode and the control electrode;

a second transistor having a control electrode coupled to the control electrode of the first transistor, the second transistor being configured to operate as a diode;

a first switching element coupled to a main electrode of the second transistor, wherein the first switching element transfers the data voltage from the data lines to the second transistor in response to the current selection signal, so as to charge the capacitor with the data voltage;

a second switching element for transferring a precharge voltage to the control electrode of the first transistor in response to the previous selection signal before the data voltage is supplied; and a third switching element configured to be turned off in response to the previous selection signal for electrically isolating the first transistor from the display element, so as to prevent a current from being applied to the dispaly element while the capacitor is being charged with the precharge voltage.

2. The display panel as claimed in claim 1, wherein the third switching element is coupled between the first transistor and the display element.

3. The display panel as claimed in claim 1, wherein the data voltage is applied to the data lines after transferring the precharge voltage in response to the previous selection signal and before applying the current selection signal to the current scan line.

4. The display panel as claimed in claim 3, wherein the data voltage in the data lines is changed to a desired voltage before the current selection signal is applied to the current scan line.

5. The display panel as claimed in claim 1, wherein the second switching element comprises a transistor of a first conductive type, the third switching element comprises a transistor of a second conductive type, the second conductive type being an opposite of the first conductive type.

6. The display panel as claimed in claim 1, wherein the third switching element is turned off during a time period of transferring the precharge voltage using the previous selection signal and another time period of transferring the data voltage using the current selection signal from the current scan line.

7. The display panel as claimed in claim 1, wherein the first and second switching elements are transistors of the same type as the first and second transistors.

8. The display panel as claimed in claim 1, wherein the precharge voltage is lower than a lowest data voltage from the data lines.

9. An image display device comprising:

the display panel according to claim 1;

a data driver mounted on the display panel or coupled to the display panel, said data driver being for applying the data voltage to the data lines; and a scan driver mounted on the display panel or coupled to the display panel, said scan driver being for applying the selection signals to the scan lines.

10. A display panel for image display, said display panel comprising a plurality of data lines for transferring a data voltage representing an image signal, a plurality of scan lines, and a plurality of pixel circuits, each pixel circuit being coupled to a corresponding said data line, a current scan line among the scan lines for transferring a current selection signal and a previos scan line among the scan lines for transferring a previous selection signal, each pixel circuit comprising:

a display element for displaying a portion of an image, the image portion corresponding to a quantity of applied current;

a first transistor having a main electrode and a control electrode;

a capacitor coupled between the main electrode and the control electrode of the first transistor, wherein the first transistor is for generating the applied current in response to voltage between the main electrode and the control electrode;

a second transistor having a control electrode coupled to the control electrode of the first transistor, the second transistor being configured to operate as a diode;

a first switching element coupled to a main electrode of the second transistor, wherein the first switching element transfers the data voltage from the data lines to the second transistor in response to the current selection signal;

a second switching element for transferring a precharge voltage to the control electrode of the first transistor in response to the previous selection signal before the data voltage is supplied; and a third switching element configured to be turned off in response to the previous selection signal for electrically isolating the first transistor from the display element, wherein the second switching element comprises a transistor of a first conductive type, the third switching element comprises a transistor of a second conductive type, the second conductive type being an opposite of the first conductive type.

11. A display panel for image display, said display panel comprising a plurality of data lines for transferring a data voltage representing an image signal, a plurality of scan lines for transferring a selection signal, and a plurality of pixel circuits, each pixel circuit being coupled to a corresponding said data line and two adjacent said scan lines, each pixel circuit comprising:

a display element for displaying a portion of an image, the image portion corresponding to a quantity of applied current;

a first transistor having a main electrode and a control electrode;

a capacitor coupled between the main electrode and the control electrode of the first transistor, wherein the first transistor is for generating the applied current in response to voltage between the main electrode and the control electrode;

a second transistor having a control electrode coupled to the control electrode of the first transistor, the second transistor being configured to operate as a diode;

a first switching element coupled to a main electrode of the second transistor, wherein the first switching element transfers the data voltage from the data lines to the second transistor in response to the selection signal from one of the two adjacent scan lines;

a second switching element for transferring a precharge voltage to the control electrode of the first transistor in response to a first control signal before the data voltage is supplied; and a third switching element configured to be turned off in response to a second control signal for electrically isolating the first transistor from the display element, wherein the two adjacent scan lines comprise a current scan line and a previous scan line, and said one of the two adjacent scan lines is the current scan line, wherein the third switching element is turned off during a time period of transferring the precharge voltage using the first control signal and another time period of transferring the data voltage using the selection signal from the current scan line, and wherein the third switching element comprises third and fourth transistors coupled in series, the second control signal comprising a third control signal for turning the third transistor off during the time period of transferring the precharge voltage, and a fourth control signal for turning the fourth transistor off during said another time period of transferring the data voltage.

12. The display panel as claimed in claim 11, wherein the selection signal from the previous scan line is used as both the first and third control signals, the second switching element is a transistor of a first conductive type, the third switching element is a transistor of a second conductive type, and the second conductive type is an opposite of the first conductive type.

13. The display panel as claimed in claim 11, wherein the fourth control signal is a selection signal from the current scan line, and the fourth transistor is a transistor of a type that is opposite of the type of the first transistor.

14. A method for driving an image display device coupled to a current scan line and a previous scan line among a plurality of scan lines, the image display device comprising a first transistor having a main electrode and a control electrode; a capacitor coupled between the main electrode and the control electrode of the first transistor, the first transistor being for generating a current corresponding to a voltage charged in the capacitor, a second transistor having a control electrode coupled to the control electrode of the first transistor and being configured to operate as a diode, and a display element for displaying a portion of an image corresponding to a quantity of the current generated by the first transistor, the method comprising:

transferring a precharge voltage to the control electrode of the first transistor in response to a previous selection signal from the previous scan line during a first time period;

transferring a data voltage to the control electrode of the first transistor through the second transistor in response to a current selection signal from the current scan line during a second time period; and interrupting the transfer of the data voltage, wherein the first transistor is electrically isolated fromthe display element in response to the previous selection signal during the first time period.

15. A method for driving a voltage programming type image display device coupled to two adjacent scan lines, the image display device comprising a first transistor having a main electrode and a control electrode; a capacitor coupled between the main electrode and the control electrode of the first transistor, the first transistor being for generating a current corresponding to a voltage charged in the capacitor, a second transistor having a control electrode coupled to the control electrode of the first transistor and being configured to operate as a diode, and a display element for displaying a portion of an image corresponding to a quantity of the current generated by the first transistor, the method comprising:

transferring a precharge voltage to the control electrode of the first transistor in response to a first control signal during a first time period;

transferring a data voltage to the control electrode of the first transistor through the second transistor in response to a selection signal from one of the two adjacent scan lines during a second time period; and interrupting the transfer of the data voltage, wherein the first transistor is electrically isolated from the display element during at least one of the first time period in which a capacitor coupled to the first transistor is charged with the precharge voltage or the second time period in which the capacitor is charged with the data voltage, wherein the first transistor is electrically isolated from the display element in response to a second control signal during the second time period, wherein the second control signal is the selection signal from said one of the two adjacent scan lines, and wherein the first transistor is electrically isolated from the display element in response to the first control signal during the first time period.

16. A method for driving a voltage programming type image display device coupled to two adjacent scan lines, the image display device comprising a first transistor having a main electrode and a control electrode; a capacitor coupled between the main electrode and the control electrode of the first transistor, the first transistor being for generating a current corresponding to a voltage charged in the capacitor, a second transistor having a control electrode coupled to the control electrode of the first transistor and being configured to operate as a diode, and a display element for displaying a portion of an image corresponding to a quantity of the current generated by the first transistor, the method comprising:

transferring a precharge voltage to the control electrode of the first transistor in response to a first control signal during a first time period;

transferring a data voltage to the control electrode of the first transistor through the second transistor in response to a selection signal from one of the two adjacent scan lines during a second time period;

interrupting the transfer of the data voltage; and preventing the precharge voltage and the data voltage from being transferred to the control electrode of the first transistor between the first and second time periods, wherein the first transistor is electrically isolated from the display element during at least one of the first time period in which a capacitor coupled to the first transistor is charged with the precharge voltage or the second time period in which the capacitor is charged with the data voltage, wherein the first transistor is electrically isolated from the display element in response to a second control signal during the second time period, wherein the second control signal is the selection signal from said one of the two adjacent scan lines, and wherein the two adjacent scan lines comprise a current scan line and a previous scan line, wherein said one of the two adjacent scan lines is the current scan line.

17. A method for driving an image display device coupled to two adjacent scan lines the image display device comprising a first transistor having a main electrode and a control electrode; a capacitor coupled between the main electrode and the control electrode of the first transistor, the first transistor being for generating a current corresponding to a voltage charged in the capacitor, a second transistor having a control electrode coupled to the control electrode of the first transistor and being configured to operate as a diode, and a display element for displaying a portion of an image corresponding to a quantity of the current generated by the first transistor, the method comprising:

transferring a precharge voltage to the control electrode of the first transistor in response to a first control signal during a first time period;

transferring a data voltage to the control electrode of the first transistor through the second transistor in response to a selection signal from one of the two adjacent scan lines during a second time period;

interrupting the transfer of the data voltage; and preventing the precharge voltage and the data voltage from being transferred to the control electrode of the first transistor between the first and second time periods, wherein the first transistor is electrically isolated from the display element during at least one of the first time period or the second time period, wherein the two adjacent scan lines comprise a current scan line and a previous scan line, wherein said one of the two adjacent scan lines is the current scan line, wherein the first control signal is a selection signal from the previous scan line, the first transistor is electrically isolated from the display element in response to the selection signal from the previous scan line during the first time period, and the first transistor is electrically isolated from the display element in response to the selection signal from the current scan line during the second time period.

18. A voltage programming type pixel circuit, which responds to a precharge voltage from a first signal line and a data voltage representing an image signal from a second signal line, the pixel circuit coupled to a current scan line and a previous scan line, the pixel circuit comprising:

a first transistor having a main electrode and a control electrode;

a capacitor coupled between the main electrode and the control electrode, wherein the first transistor is for generating a current in response to a voltage charged in the capacitor;

a second transistor having a control electrode coupled to the control electrode of the first transistor, the second transistor being configured to operate as a diode;

a display element for displaying a portion of an image, said image portion corresponding to the current generated by the first transistor; and switching means coupled between the first transistor and the display element, wherein the precharge voltage is applied to the control electrode of the first transistor in response to a previous selection signal from the previous scan line for a first time period, and the data voltage is applied to the control electrode of the first transistor in response to a current select signal from the current scan line for a second time period, and the first transistor is electrically isolated from the display element by the switching means during at least one of the first time period in which the capacitor is charged with the precharge voltage, or the second time period in which the capacitor is charged with the data voltage, and wherein the switching means is controlled by the previos select signal.

19. A display device comprising:

a display element for displaying a portion of an image in response to a current being applied;

a first transistor having a main electrode and a control electrode, and coupled between a voltage source and the display element;

a capacitor coupled between the main electrode and the control electrode, wherein the first transistor is for generating the current in response to a charge in the capacitor;

a first switching element coupled between the first transistor and the display element to interrupt the current to the display element while charging the capacitor using at least one of a precharge voltage or a data voltage representative of the image portion; and a second switching element coupled to a selection signal, wherein, when the selection signal is activated, the second switching element allows the data voltage to be applied to the capacitor for charging and the first switching element is turned off to prevent the current from flowing to the display element.

20. A display device comprising:

a display element for displaying a portion of an image in response to a current being applied;

a first transistor having a main electrode and a control electrode, and coupled between a voltage source and the display element;

a capacitor coupled between the main electrode and the control electrode, wherein the first transistor is for generating the current in response to a charge in the capacitor;

a first switching element coupled between the first transistor and the display element to interrupt the current to the display element while charging the capacitor using at least one of a precharge voltage or a data voltage representative of the image portion;

a second switching element coupled to a first selection signal, wherein, when the first selection signal is activated, the second switching element allows the precharge voltage to be applied to the capacitor for charging and the first switching element is turned off to prevent the current from flowing to the display element; and a third switching element coupled to a second selection signal, wherein, when the second selection signal is activated, the third switching element allows the data voltage to be applied to the capacitor for charging and the first switching element is turned off to prevent the current from flowing to the display element.

21. The display device of claim 20, wherein there is a time period between when the first selection signal is un-activated and when the second selection signal is activated.

22. The display device of claim 19, wherein the first switching element is turned on to allow the current to flow to the display element when the selection signal is un-activated after the capacitor has been charged using the data voltage.

23. The display device of claim 20, further comprising a second transistor having a control electrode coupled to the control electrode of the first transistor, said control electrodes being coupled to the precharge voltage via the second switching element, wherein the second transistor is configured to operate as a diode.

24. A display device comprising:

a display element for displaying a portion of an image in response to a current being applied;

a first transistor having a main electrode and a control electrode, and coupled between a voltage source and the display element;

a capacitor coupled between the main electrode and the control electrode of the first transistor, wherein the first transistor is for generating the current in response to a charge in the capacitor;

a first switching element coupled between the first transistor and the display element to interrupt the current to the display element while charging the capacitor using at least one of a precharge voltage or a data voltage representative of the image portion;

a second switching element coupled to a selection signal, wherein, when the selection signal is activated, the second switching element allows the data voltage to be applied to the capacitor for charging and the first switching element is turned off to prevent the current from flowing to the display element; and a second transistor having a control electrode and a main electrode, wherein the control electrode of the second transistor is coupled to the control electrode of the first transistor, the main electrode of the second transistor is coupled to the data voltage via the second switching element, and the second transistor is configured to operate as a diode.

* * * * *

UNITED STATES PATENT AND TRADEMARK OFFICE

CERTIFICATE OF CORRECTION

PATENT NO. : 7,403,176 B2
APPLICATION NO. : 10/634337
DATED : July 22, 2008
INVENTOR(S) : Bo-Yong Chung et al.

It is certified that error appears in the above-identified patent and that said Letters Patent is hereby corrected as shown below:

In the Claims

| | |
|---|---|
| Column 10, line 18, Claim 1 | Delete "tranferring",<br>Insert --transferring-- |
| Column 10, line 46, Claim 1 | Delete "dispaly",<br>Insert --display-- |
| Column 11, line 25, Claim 10 | Delete "previos",<br>Insert --previous-- |
| Column 11, line 36, Claim 10 | After "response to",<br>Insert --a-- |
| Column 12, line 9, Claim 11 | After "response to",<br>Insert --a-- |
| Column 13, line 10, Claim 14 | Delete "fromthe",<br>Insert --from the-- |
| Column 15, line 21, Claim 18 | Delete "previos",<br>Insert --previous-- |

Signed and Sealed this

Thirtieth Day of December, 2008

JON W. DUDAS
*Director of the United States Patent and Trademark Office*